US009825392B1

(12) United States Patent
Chen

(10) Patent No.: US 9,825,392 B1
(45) Date of Patent: Nov. 21, 2017

(54) HIGH SPEED CONNECTOR ASSEMBLY, RECEPTACLE CONNECTOR AND RECEPTACLE TERMINAL

(71) Applicant: OUPIIN ELECTRONIC (KUNSHAN) CO., LTD, Kunshan (CN)

(72) Inventor: Hsin Chih Chen, Kunshan (CN)

(73) Assignee: OUPIIN ELECTRONIC (KUNSHAN) CO., LTD, Kunshan (CN)

( * ) Notice: Subject to any disclaimer, the term of this patent is extended or adjusted under 35 U.S.C. 154(b) by 0 days.

(21) Appl. No.: 15/412,069

(22) Filed: Jan. 23, 2017

(30) Foreign Application Priority Data

Jun. 22, 2016 (CN) ..... 2016 1 0455347

(51) Int. Cl.

| | |
|---|---|
| ***H01R 11/22*** | (2006.01) |
| ***H01R 13/11*** | (2006.01) |
| ***H01R 13/514*** | (2006.01) |
| *H01R 13/6594* | (2011.01) |
| *H01R 12/72* | (2011.01) |

(52) U.S. Cl.
CPC ..... *H01R 13/112* (2013.01); *H01R 13/114* (2013.01); *H01R 13/514* (2013.01); *H01R 12/724* (2013.01); *H01R 13/6594* (2013.01)

(58) Field of Classification Search
USPC ..... 439/607.07, 856, 857
See application file for complete search history.

(56) References Cited

U.S. PATENT DOCUMENTS

| | | | | |
|---|---|---|---|---|
| 4,973,273 | A * | 11/1990 | DePriest | H01R 13/11 439/856 |
| 5,672,084 | A * | 9/1997 | Feldman | H01R 13/11 439/852 |
| 6,224,432 | B1 * | 5/2001 | Billman | H01R 13/113 439/856 |
| 6,328,602 | B1 * | 12/2001 | Yamasaki | H01R 13/6585 439/607.11 |
| 6,971,928 | B2 * | 12/2005 | Shindo | H01R 13/05 439/857 |
| 7,789,708 | B2 * | 9/2010 | Laurx | H01R 13/514 439/108 |
| 9,362,646 | B2 * | 6/2016 | Cohen | H01R 13/02 |
| 2001/0004568 | A1 * | 6/2001 | Kikuchi | H01R 13/112 439/857 |

* cited by examiner

*Primary Examiner* — Tho D Ta
(74) *Attorney, Agent, or Firm* — Mark M. Friedman

(57) ABSTRACT

A high speed connector assembly is disclosed in this invention, which includes a receptacle connector and a plug connector. Each differential signal terminal of the receptacle connector has an L-type body, a front mating portion and a bottom mounting portion. The front mating portion includes two L-type arms having unequal length. A front end of each L-type arm disposes a resilient contact finger being perpendicular to a vertical plane. The resilient contact fingers of the two L-type arms can respectively and electrically contact with two opposite sides of one plug terminal of the plug connector, thereby forming double-sided contact. The present invention can suppress the short pile effect and reduce signal crosstalk and signal loss during transmitting the high speed signal by this double contact.

8 Claims, 8 Drawing Sheets

HIGH SPEED CONNECTOR ASSEMBLY, RECEPTACLE CONNECTOR AND RECEPTACLE TERMINAL

BACKGROUND OF THE INVENTION

1. Field of the Invention

The present invention relates to a connector technology, and more particularly to a high speed connector assembly, a receptacle connector and a receptacle terminal, which can form double-sided contact with a plug terminal.

2. Description of the Prior Art

In the electronics industry, a right-angle high speed connector assembly can provide a connection interface for multiple circuit boards. For example, it can connect two orthogonal circuit boards to shorten the signal transmission channel length of these systems and improve the channel performance of signal integrity.

The high speed connector assembly is one common connector, which is used for large scale communication equipment, a super high performance server, a huge computer, an industrial computer and a high end storage device. This highly flexible high performance connector has become an ideal choice for telecommunications and data network applications.

However, it is a very important issue how to provide greater throughput and ensure more stable and reliable signal transmission by changing the signal transmission path between a receptacle connector and a plug connector under the condition of no redesign to above connection.

BRIEF SUMMARY OF THE INVENTION

One object of the present invention is to provide a high speed connector assembly, which comprises a receptacle connector and a plug connector, wherein each receptacle terminal can contact with two opposite sides of one corresponding plug terminal to form double-sided contact, thereby restraining the short pile effect and reducing the crosstalk and loss at high speed signal transmission.

The other object of the present invention is to provide a receptacle connector, each receptacle terminal of which can contact with two opposite sides of one corresponding plug terminal to form double-sided contact, thereby restraining the short pile effect and reducing the crosstalk and loss at high speed signal transmission.

Another object of the present invention is to provide a receptacle terminal, which can contact with two opposite sides of one corresponding plug terminal to form double contacts, thereby restraining the short pile effect and reducing the crosstalk and loss at high speed signal transmission.

Other objects and advantages of the present invention may be further understood from the technical features disclosed by the present invention.

To achieve the aforementioned object or other objects of the present invention, the present invention adopts the following technical solution.

The present invention provides a high speed connector assembly, which comprises a receptacle connector and a plug connector. The receptacle connector includes multiple terminal modules arranged in parallel. Each terminal module includes an insulating frame and a receptacle terminal group retained in the insulating frame. The receptacle terminal group includes multiple pairs of differential signal terminals located in one vertical plane. Each differential signal terminal has an L-type body located in the vertical plane, a front mating portion extending forward from one end of the body, and a bottom mounting portion extending downward from the other end of the body. Wherein the front mating portion includes two unequal L-type arms, which are connected to the body and extend forward, and each of which forms a resilient contact finger located on the front of the arm and being perpendicular to the vertical plane. The resilient contact fingers of the two L-type arms are located on one side of the vertical plane and are staggered along an extension direction of the two L-type arms. The plug connector includes multiple plug terminals, each of which has two opposite sides. Wherein the resilient contact fingers of the two L-type arms can electrically and respectively contact with the two opposite sides of the corresponding plug terminal.

In one embodiment, the two L-type arms are respectively a first arm and a second arm, the length of the second arm is greater than that of the first arm, and the first arm is located above the second arm. The first arm forms a first resilient contact finger thereon, and the second arm forms a second resilient contact finger thereon; and the second resilient contact finger is located on front of the first resilient contact finger. A bottom surface of the first resilient contact finger is a downward convex surface, and a top surface of the second resilient contact finger is an upward convex surface. The two convex surfaces can electrically and respectively contact with the two opposite sides of the corresponding plug terminal.

In one embodiment, each plug terminal has a straight mating part with the rectangular cross section, and the two opposite sides are two opposite wide surfaces of the plug terminal; when the receptacle connector and the plug connector are electrically mated together, the two convex surfaces can electrically and respectively contact with the two opposite wide surfaces of the plug terminal.

In one embodiment, the receptacle connector further includes a base and an insulating cover for retaining these terminal modules; and each terminal module further includes a grounding plate mounted on one side of the insulating frame.

The present invention also provides a receptacle connector, which comprises a base, an insulating cover and multiple terminal modules arranged in parallel. Each terminal module includes an insulating frame, a receptacle terminal group retained in the insulating frame and a grounding plate mounted on one side of the insulating frame. The receptacle terminal group includes multiple pairs of differential signal terminals located in one vertical plane. Each differential signal terminal has an L-type body located in the vertical plane, a front mating portion extending forward from one end of the body, and a bottom mounting portion extending downward from the other end of the body. The front mating portion includes two unequal L-type arms, which are connected to the body and extend forward, and each of which forms a resilient contact finger located on the front of the arm and being perpendicular to the vertical plane. The resilient contact fingers of the two L-type arms are located on one side of the vertical plane and are staggered along an extension direction of the two L-type arms. Wherein the resilient contact fingers of the two L-type arms can electrically and respectively contact with two opposite sides of one plug terminal of a plug connector.

The present invention further provides a receptacle terminal, which comprises an L-type body located in a vertical plane, a front mating portion extending forward from one end of the body and a bottom mounting portion extending downward from the other end of the body. The front mating portion includes two unequal L-type arms, which are connected to the body and extend forward, and each of which forms a resilient contact finger located on the front of the arm and being perpendicular to the vertical plane. The resilient contact fingers of the two L-type arms are located on one same side of the vertical plane and are staggered along an extension direction of the two L-type arms. Wherein the resilient contact fingers of the two L-type arms can electrically and respectively contact with two opposite sides of one plug terminal of a plug connector.

In comparison with the prior art, the receptacle terminal of the present invention can form double-sided contact with one plug terminal by employing the two unequal L-type arms and the two staggered resilient contact finger. By this electrical engagement, the high speed connector assembly, the receptacle connector and the receptacle terminal of the present invention can restrain the short pile effect and reduce the crosstalk and loss when the transmission rate of the high speed signal is greater than 25 Gbps~40 Gbps.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Figure 1:
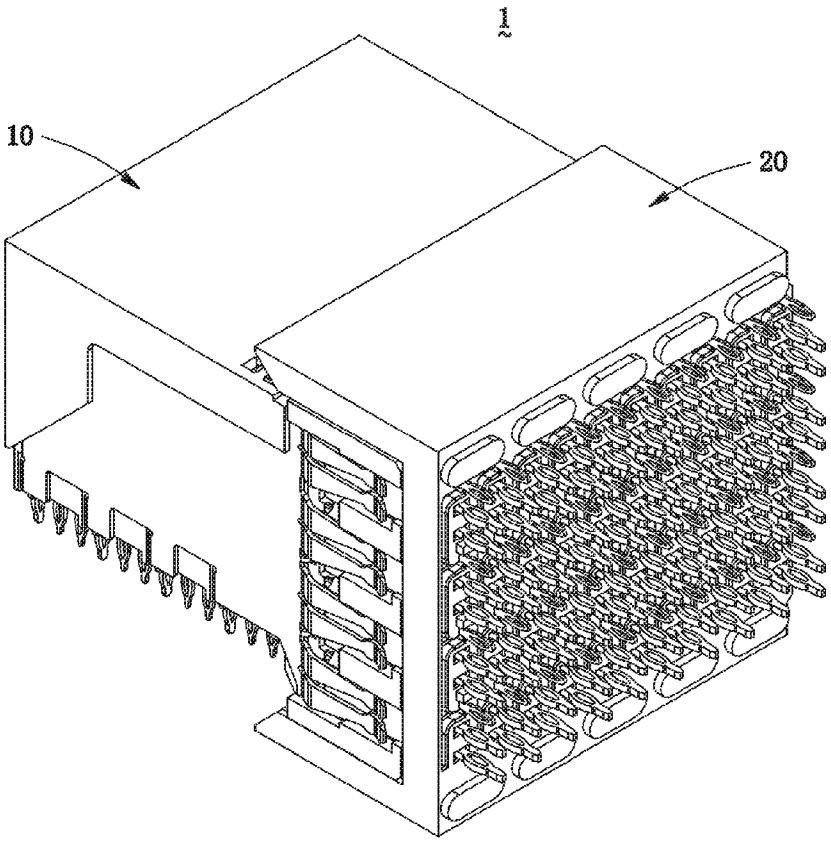
FIG. 1 is a perspective view of a high speed connector assembly of the present invention.
Figure 2:
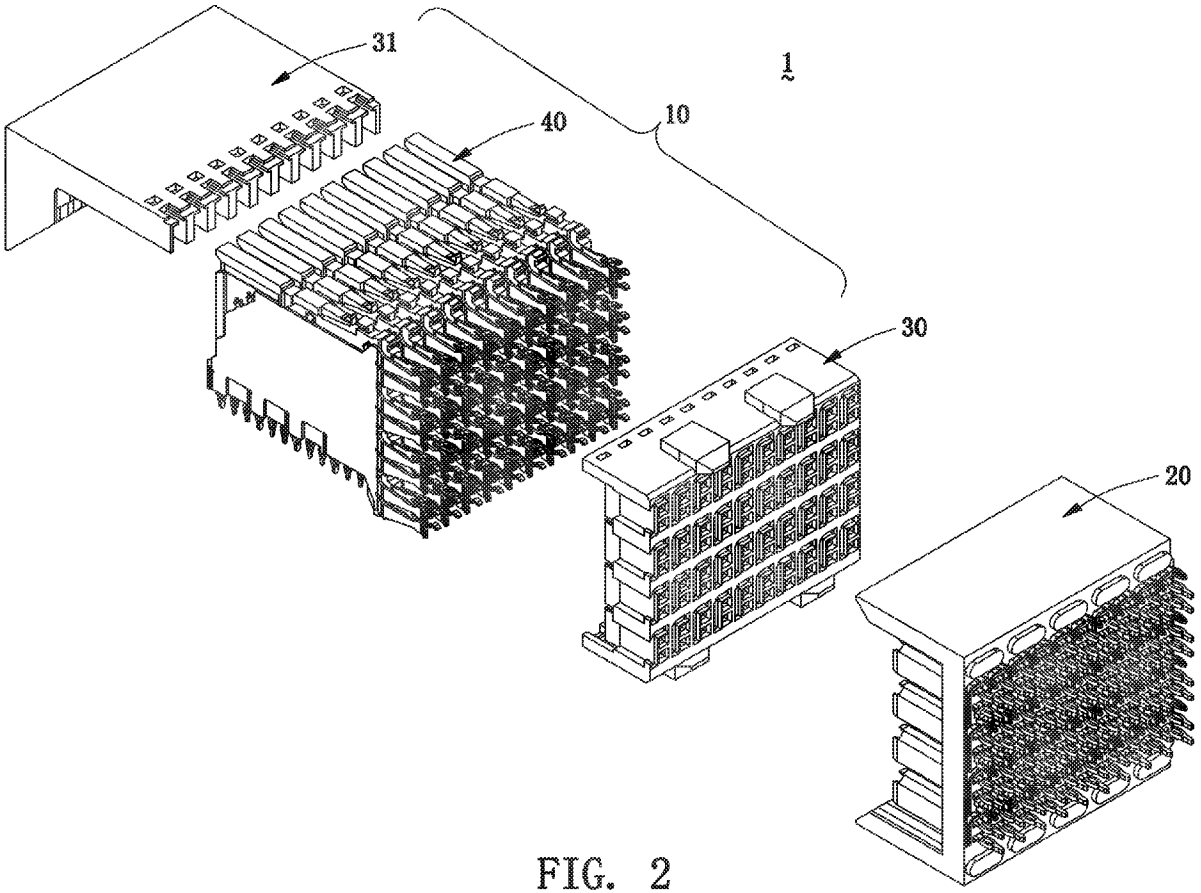
FIG. 2 is a disassembled view of the high speed connector assembly of the present invention.
Figure 3:
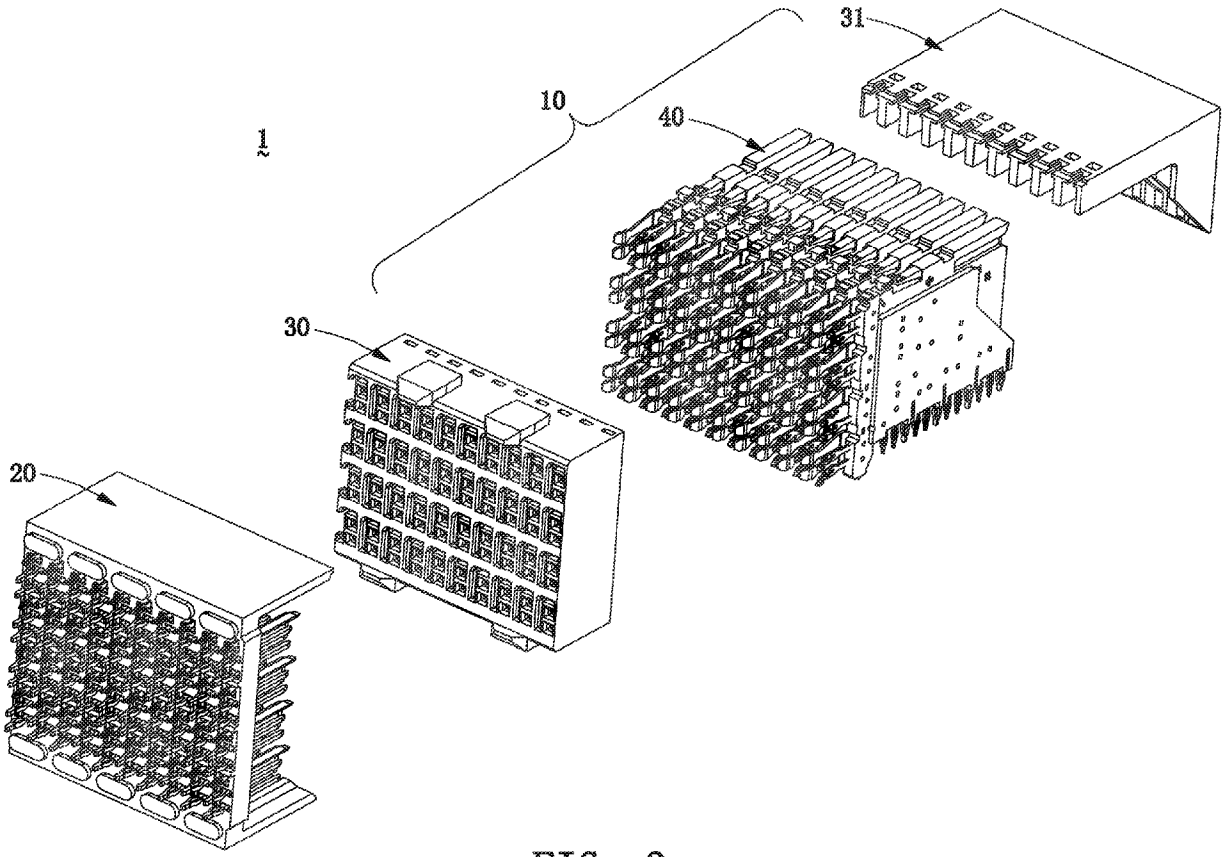
FIG. 3 is a disassembled view of the high speed connector assembly along another direction.

Please refer to FIGS. 1 to 3, a high speed connector assembly 1 of the present invention includes a receptacle connector 10 and a plug connector 20. The receptacle connector 10 may be a right-angle connector, the mating direction of which is parallel to a horizontal circuit board (not shown), on which the receptacle connector 10 is mounted. The plug connector 20 may be a vertical end connector, the mating direction of which is perpendicular to a vertical circuit board (not shown), on which the plug connector 20 is mounted.

Please refer to FIGS. 2 and 3, the receptacle connector 10 includes at least a base 30, an insulating cover 31 and multiple terminal modules 40 arranged in parallel and fixed together. In the embodiment, the receptacle connector 10 of the present invention includes eight terminal modules 40. But in other embodiments, the number of the terminal modules 40 can be changed in order to increase the density of the receptacle connector 10.

Figure 4:
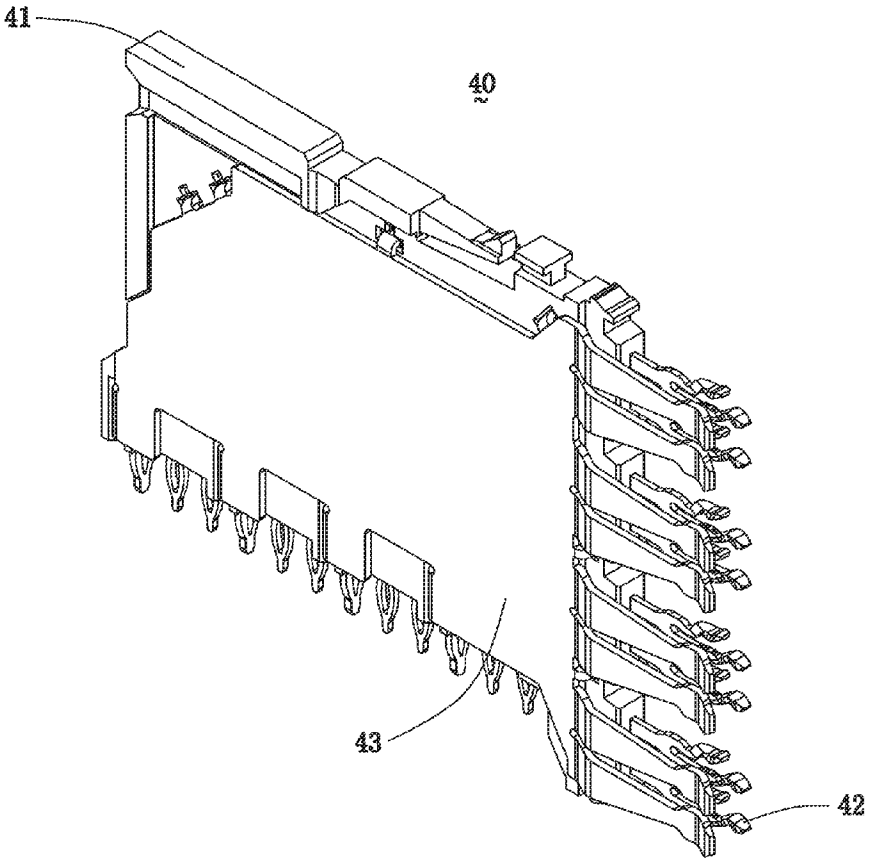
FIG. 4 is a perspective view of one terminal module of a receptacle connector of the present invention.
Figure 5:
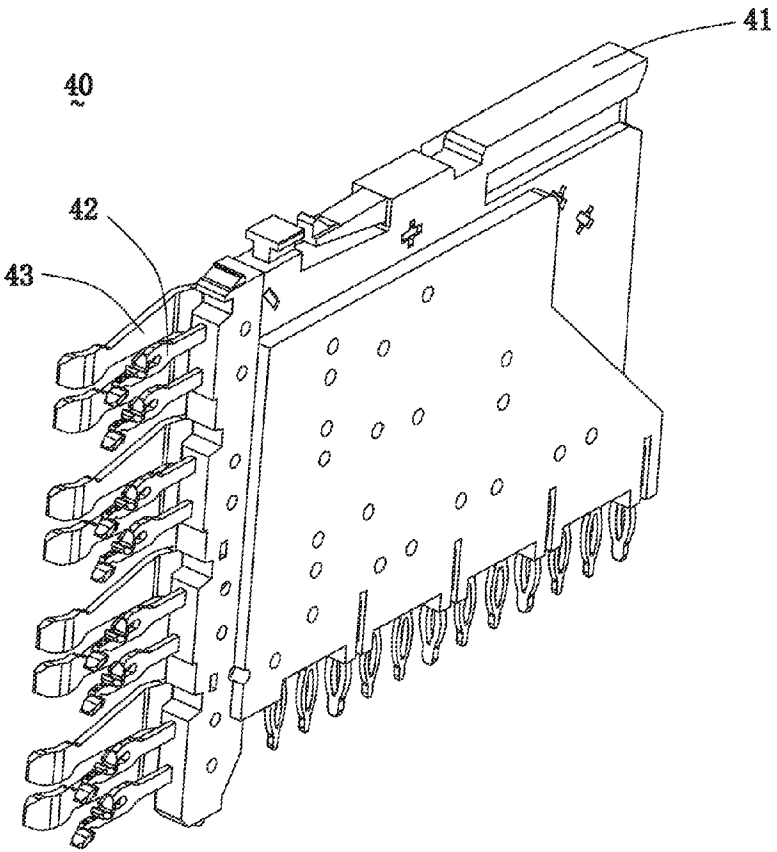
FIG. 5 is a perspective view of the terminal module along another direction.

Please refer to FIGS. 4 and 5, each terminal module 40 includes an insulating frame 41, a receptacle terminal group 42 retained in the insulating frame 41, and a grounding plate 43 mounted on one side of the insulating frame 41.

Figure 6:
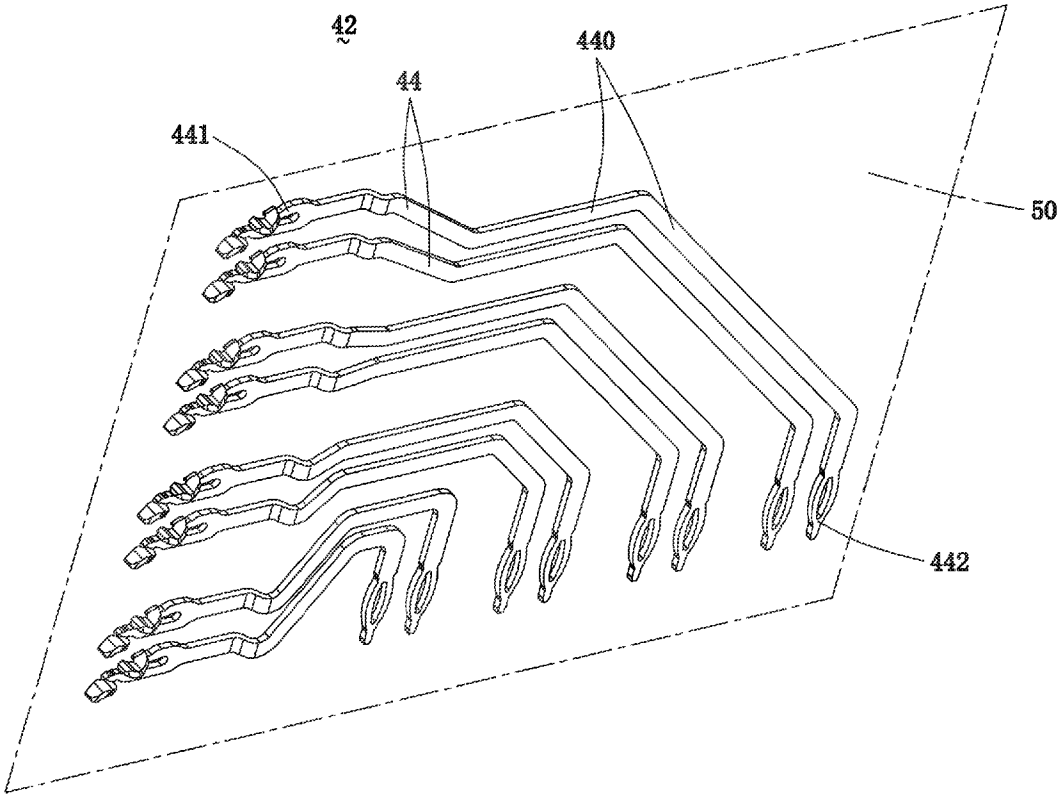
FIG. 6 is a perspective view of one receptacle terminal group of a receptacle connector of the present invention.

Please refer to FIG. 6, the receptacle terminal group 42 includes multiple pairs of differential signal terminals 44, which are located in a same vertical plane 50. Each pair of differential signal terminals 44 includes two differential signal terminals 44.

Figure 7:
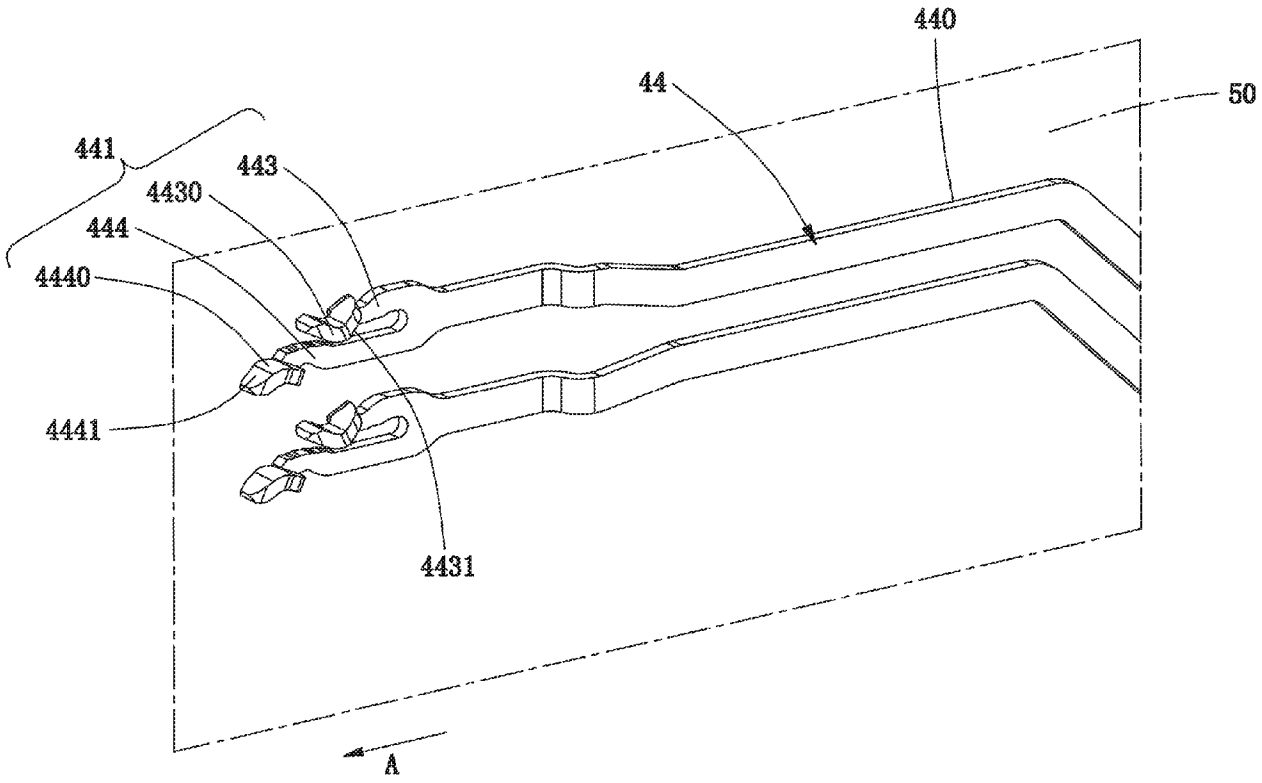
FIG. 7 is an enlarged view of one pair of differential signal terminals in the receptacle terminal group shown by FIG. 6.

Please refer to FIGS. 6 and 7, each differential signal terminal 44 has an L-type body 440 located in the vertical plane 50, a front mating portion 441 extending forward from one end of the body 440, and a bottom mounting portion 442 extending downward from the other end of the body 440.

Referring FIG. 7, the front mating portion 441 includes two unequal L-type arms 443, 444, which are connected to the body 440 and extend forward. The two L-type arms 443, 444 are respectively a first arm 443 and a second arm 444. The first arm 443 forms a first resilient contact finger 4430, which is located on the front of the first arm 443 and perpendicular to the vertical plane 50. The second arm 444 forms a second resilient contact finger 4440, which is located on the front of the second arm 444 and perpendicular to the vertical plane 50. The first and second resilient contact fingers 4430, 4440 are staggered along an extension direction A of the two L-type arms 443, 444 and located on one same side of the vertical plane 50.

In the embodiment, the first resilient contact finger 4430 is vertically bent from the top of the first arm 443, and the second resilient contact finger 4440 is vertically bent from the bottom of the second arm 443, so the first and second arms 443, 444 are both formed in L-shape.

In the embodiment, the length of the second arm 444 is greater than that of the first arm 443, so the second resilient contact finger 4440 is located on front of the first resilient contact finger 4430. Moreover, the first arm 443 is located above the second arm 444.

Referring to FIG. 7, in the embodiment, a bottom surface of the first resilient contact finger 4430 is a downward convex surface 4431, and a top surface of the second resilient contact finger 4440 is an upward convex surface 4441. The two convex surfaces 4431, 4441 can electrically contact with two opposite sides of a plug terminal 21 shown in FIG. 8.

Referring to FIG. 6, the bottom mounting portion 442 is a needle shaped pin, which can be connected to a signal point of the horizontal circuit board.

Figure 8:
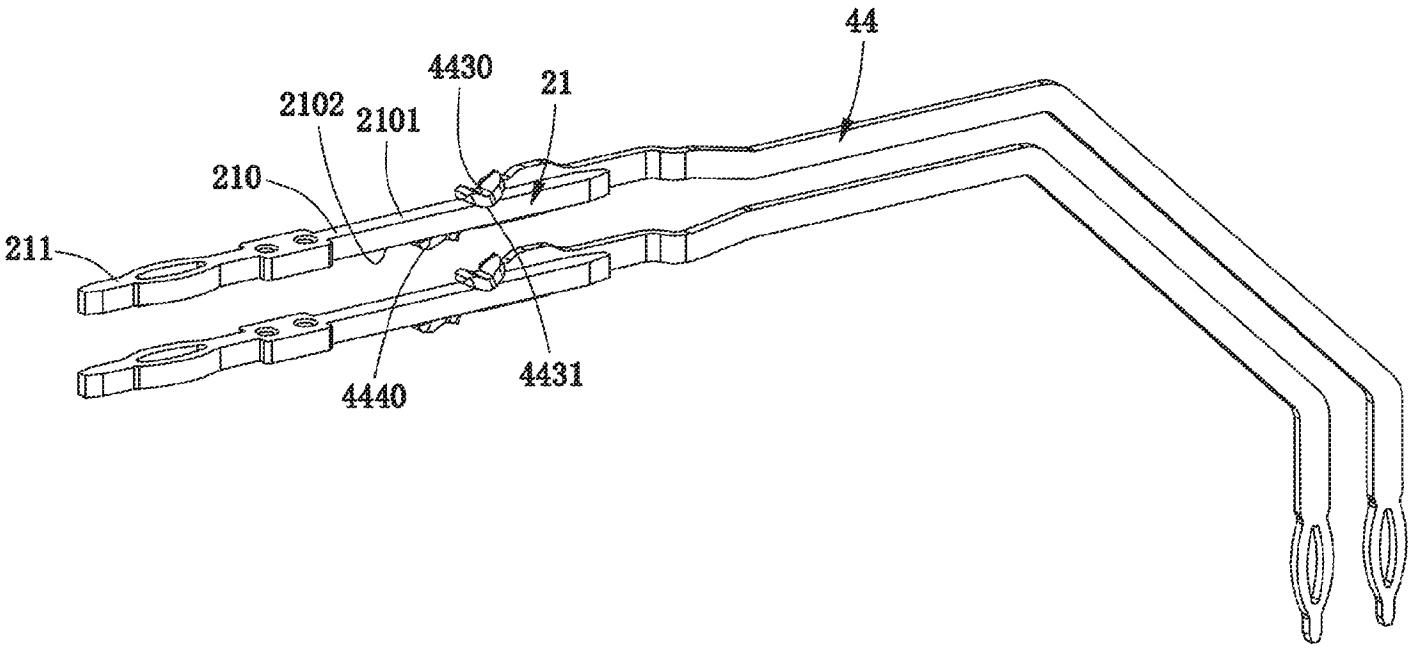
FIG. 8 is a simulation diagram showing the engagement of one pair of differential signal terminals and one pair of plug terminals.

Please refer to FIG. 8, each plug terminal 21 has a straight mating part 210 with two opposite sides 2101, 2102 and a mounting end 211 connected to the straight mating part 210. The cross section of the straight mating part 210 is rectangular. The two opposite sides 2101, 2102 are two opposite wide surfaces of the plug terminal 21.

Please refer to FIGS. 7 and 8, when the receptacle connector 10 and the plug connector 20 shown in FIG. 1 are electrically engaged with each other, first, the convex surface 4441 of the second resilient contact finger 4440 electrically contacts with one side 2102 of the plug terminal 21 and slides toward the mounting end 211 along the side 2102, and then the convex surface 4431 of the first resilient contact finger 4430 electrically contacts with the other side 2101 of the plug terminal 21 and slides toward the mounting end 211 along the other side 2101 until a predetermined position, thereby forming a complete electrical connection. By this electrical engagement, the pair of differential signal terminals 44 of the receptacle connector 10 can electrically contact with one corresponding pair of plug terminals 21 of the plug connector 20.

As described above, the receptacle terminal (namely one differential signal terminal 44) of the receptacle connector 10 of the present invention can form double-sided contact with the plug terminal 21 by the two unequal L-type arms 443, 444 and the two staggered resilient contact fingers 4430, 4440. By this design, the high speed connector assembly 1 of the present invention can restrain the short pile effect and reduce the crosstalk and loss when the transmission rate of the high speed signal is greater than 25 Gbps~40 Gbps.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high speed connector assembly, which comprises:

a receptacle connector including multiple terminal modules arranged in parallel; each terminal module including an insulating frame and a receptacle terminal group retained in the insulating frame; the receptacle terminal group including multiple pairs of differential signal terminals located in one vertical plane; each differential signal terminal having an L-type body located in the vertical plane, a front mating portion extending forward from one end of the body, and a bottom mounting portion extending downward from the other end of the body; wherein the front mating portion includes two unequal L-type arms, which are connected to the body and extend forward, and each of which forms a resilient contact finger located on the front of the arm and being perpendicular to the vertical plane; the resilient contact fingers of the two L-type arms being located on one side of the vertical plane and being staggered along an extension direction of the two L-type arms; and a plug connector including multiple plug terminals, each of which has two opposite sides;

wherein the two unequal L-type arms extend forward along the vertical plane, each resilient contact finger is perpendicular to the corresponding L-type arm, and the resilient contact fingers of the two L-type arms can electrically and respectively contact with the two opposite sides of the corresponding plug terminal.

2. The high speed connector assembly as claimed in claim 1, wherein the two L-type arms are respectively a first arm and a second arm, the length of the second arm is greater than that of the first arm, and the first arm is located above the second arm;

the first arm forms a first resilient contact finger thereon, and the second arm forms a second resilient contact finger thereon; and the second resilient contact finger is located on front of the first resilient contact finger;

a bottom surface of the first resilient contact finger is a downward convex surface, and a top surface of the second resilient contact finger is an upward convex surface; and the two convex surfaces can electrically and respectively contact with the two opposite sides of the corresponding plug terminal.

3. The high speed connector assembly as claimed in claim 2, wherein each plug terminal has a straight mating part with the rectangular cross section, and the two opposite sides are two opposite wide surfaces of the plug terminal; when the receptacle connector and the plug connector are electrically mated together, the two convex surfaces can electrically and respectively contact with the two opposite wide surfaces of the plug terminal.

4. The high speed connector assembly as claimed in claim 1, wherein the receptacle connector further includes a base and an insulating cover for retaining these terminal modules; and each terminal module further includes a grounding plate mounted on one side of the insulating frame.

5. A receptacle connector, which comprises:

a base;

an insulating cover; and multiple terminal modules, which are arranged in parallel, and each of which includes an insulating frame, a receptacle terminal group retained in the insulating frame and a grounding plate mounted on one side of the insulating frame; the receptacle terminal group including multiple pairs of differential signal terminals located in one vertical plane; each differential signal terminal having an L-type body located in the vertical plane, a front mating portion extending forward from one end of the body, and a bottom mounting portion extending downward from the other end of the body; the front mating portion including two unequal L-type arms, which are connected to the body and extend forward, and each of which forms a resilient contact finger located on the front of the arm and being perpendicular to the vertical plane; the resilient contact fingers of the two L-type arms being located on one side of the vertical plane and being staggered along an extension direction of the two L-type arms;

wherein the two unequal L-type arms extend forward along the vertical plane, each resilient contact finger is perpendicular to the corresponding L-type arm, and the resilient contact fingers of the two L-type arms can electrically and respectively contact with two opposite sides of one plug terminal of a plug connector.

6. The receptacle connector as claimed in claim 5, wherein the two L-type arms are respectively a first arm and a second arm, the length of the second arm is greater than that of the first arm, and the first arm is located above the second arm;

the first arm forms a first resilient contact finger thereon, and the second arm forms a second resilient contact finger thereon; and the second resilient contact finger is located on front of the first resilient contact finger;

a bottom surface of the first resilient contact finger is a downward convex surface, and a top surface of the second resilient contact finger is an upward convex surface; and the two convex surfaces can electrically and respectively contact with the two opposite sides of the plug terminal.

7. A receptacle terminal, which comprises:

an L-type body located in a vertical plane;

a front mating portion extending forward from one end of the body and including two unequal L-type arms, which are connected to the body and extend forward, and each of which forms a resilient contact finger located on the front of the arm and being perpendicular to the vertical plane; the resilient contact fingers of the two L-type arms being located on one same side of the vertical plane and being staggered along an extension direction of the two L-type arms; wherein the resilient contact fingers of the two L-type arms can electrically and respectively contact with two opposite sides of one plug terminal of a plug connector; and a bottom mounting portion extending downward from the other end of the body;

wherein the two unequal L-type arms extend forward along the vertical plane, each resilient contact finger is perpendicular to the corresponding L-type arm.

8. The receptacle terminal as claimed in claim 7, wherein the two L-type arms are respectively a first arm and a second arm, the length of the second arm is greater than that of the first arm, and the first arm is located above the second arm;

the first arm forms a first resilient contact finger thereon, and the second arm forms a second resilient contact finger thereon; and the second resilient contact finger is located on front of the first resilient contact finger;

a bottom surface of the first resilient contact finger is a downward convex surface, and a top surface of the second resilient contact finger is an upward convex surface; and the two convex surfaces can electrically and respectively contact with the two opposite sides of the plug terminal.

* * * * *